US005563563A

United States Patent [19]

Freitas et al.

[11] Patent Number: 5,563,563

[45] Date of Patent: Oct. 8, 1996

[54] SOLENOID WITH AN IMPROVED CONTACT DESIGN AND A SYSTEM UTILIZING THE SOLENOID

[75] Inventors: Charles M. Freitas, Chelsea; Mark R. Massicotte, Walled Lake; Xiaolin B. Xue, Novi, all of Mich.

[73] Assignee: Ford Motor Company, Dearborn, Mich.

[21] Appl. No.: 566,806

[22] Filed: Dec. 4, 1995

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 2,907,847 | 10/1959 | Grenier et al. . | |
| 3,866,960 | 2/1975 | Chohan . | |
| 4,293,835 | 10/1981 | Davis et al. . | |
| 4,488,054 | 12/1984 | Ebihara | 290/38 A |
| 4,695,735 | 9/1987 | Tallis, Jr. et al. . | |
| 4,801,909 | 1/1989 | Fasola | 335/126 |
| 4,825,180 | 4/1989 | Miyaji | 335/131 |
| 4,987,396 | 1/1991 | Bogner . | |
| 5,142,924 | 9/1992 | Fasola et al. . | |
| 5,175,524 | 12/1992 | Gotoh . | |

FOREIGN PATENT DOCUMENTS

| | | |
|---|---|---|
| 2750754 | 5/1978 | Germany . |

*Primary Examiner*—Lincoln Donovan
*Attorney, Agent, or Firm*—Mark S. Sparschu

[57] ABSTRACT

In one embodiment of the present invention, a starter motor solenoid includes two fixed contacts and a movable contact. The movable contact and one fixed contact are made of copper. The other fixed contact is made of steel. Over a relatively few cycles of the starter motor solenoid, a coating of copper is deposited from the movable contact to the steel fixed contact. Thus, despite the use of relatively inexpensive steel as fixed contact material, a highly-conductive and reliable junction is provided between the movable contact and the steel fixed contact.

20 Claims, 2 Drawing Sheets

SOLENOID WITH AN IMPROVED CONTACT DESIGN AND A SYSTEM UTILIZING THE SOLENOID

BACKGROUND OF THE INVENTION

1. Field of the Invention

The present invention relates to electrical solenoids and systems which use electrical solenoids.

2. Description of the Related Art

Electromechanical solenoids are used for many purposes. One use of solenoids is in the cranking system of a motor vehicle. In a cranking system, a starter solenoid is typically part of a starter motor assembly. The starter motor assembly also includes the cranking motor which cranks the engine. The starter solenoid typically provides a switchable electrical connection between the vehicle's battery and the cranking motor for cranking the engine. The switchable electrical connection includes two fixed contacts and a movable contact. All of these contacts are conventionally made of copper, a relatively high-conductivity (and fairly expensive) metal. Copper is used to help assure highly conductive electrical junctions between the movable contact and the two fixed contacts, electrical junctions which will remain highly conductive over years of use and thousands of make/break cycles.

The worldwide motor vehicle industry is a very competitive industry. Ways are continually being sought to reduce costs while still maintaining superior performance.

Thus, a solenoid design which can provide superior performance at reduced cost will provide an advantage over the prior art.

SUMMARY OF THE INVENTION

The present invention provides a solenoid comprising first and second fixed contacts. The solenoid further comprises a movable contact adapted to switchably couple the first and second fixed contacts together. One of the fixed contacts is made of steel.

The present invention also provides a solenoid comprising a first fixed contact, a second fixed contact and a movable contact adapted to switchably couple the first and second fixed contacts together. The movable contact and one of the fixed contacts are made of different base materials.

The present invention also provides a solenoid comprising a copper terminal stud having an integral first fixed contact, a steel terminal stud having an integral second fixed contact and a copper movable contact disposed in opposition to the first and second fixed contacts for switchably coupling the first and second fixed contacts.

The present invention provides a solenoid having a reduced cost over alternative designs while still providing superior performance. In doing so, the present invention provides advantages over the prior art.

DETAILED DESCRIPTION OF THE PREFERRED EMBODIMENT

Figure 1:
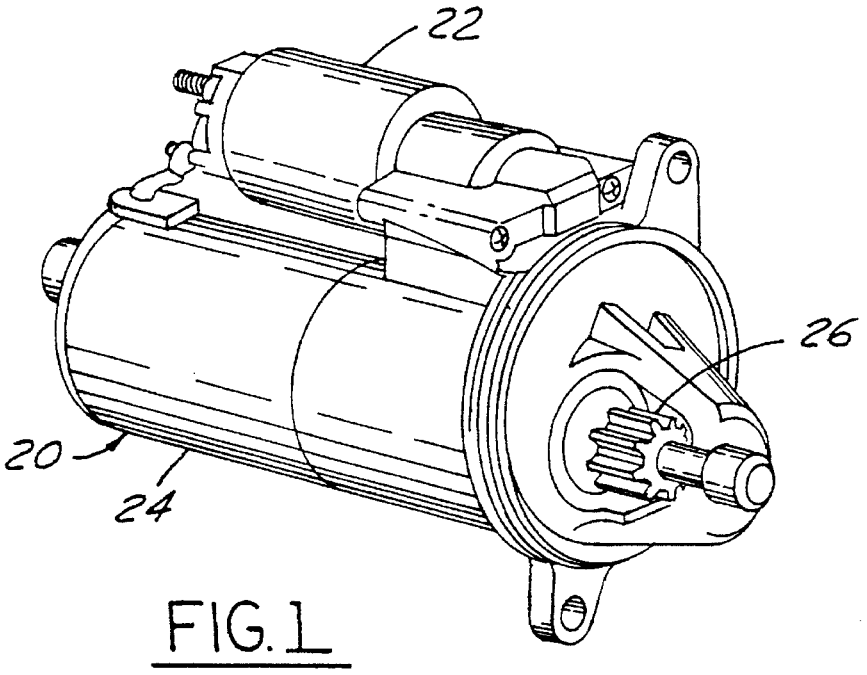
FIG. 1 is a perspective view of a starter motor assembly 20 according to one embodiment of the present invention.

Referring to FIG. 1, a starter motor assembly 20 for a motor vehicle is shown. Starter motor assembly 20 includes solenoid 22 and cranking motor 24. As is familiar to those skilled in the art, solenoid 22 has two functions. First, solenoid 22 provides mechanical force necessary to cause pinion gear 26 to engage with a ring gear (not shown) on the engine of the motor vehicle. Second, solenoid 22 provides a switchable electrical connection from a vehicle battery to cranking motor 24 for cranking the engine.

Figure 2:
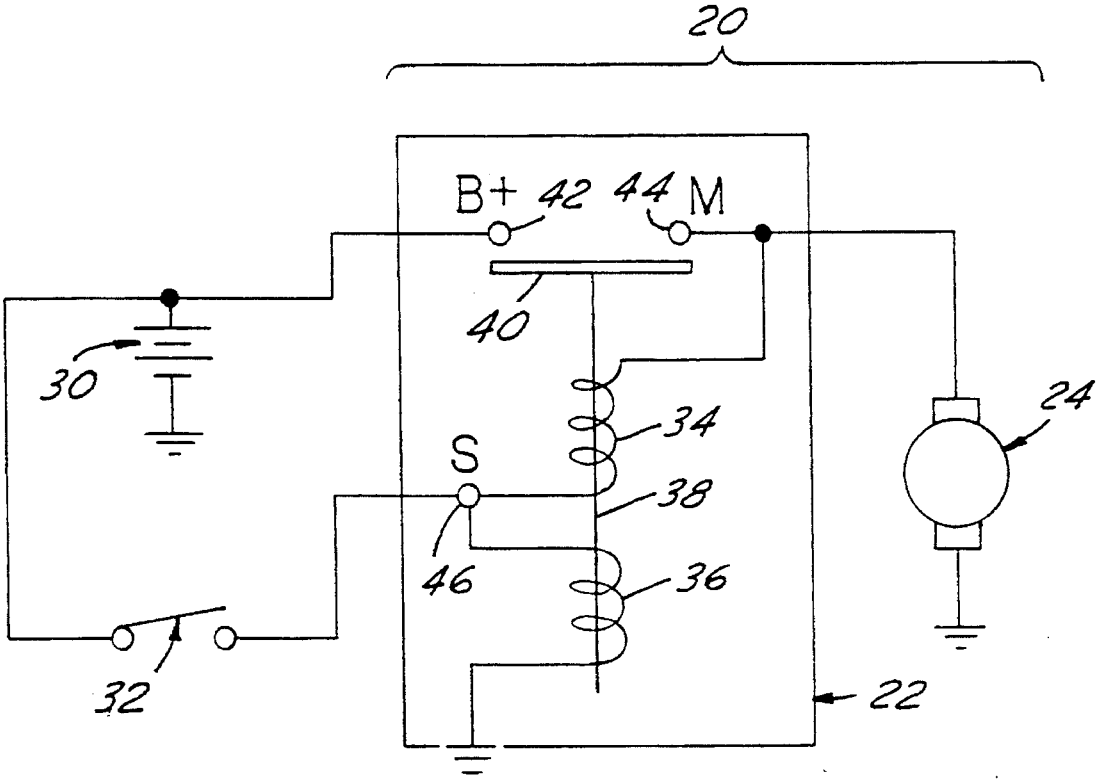
FIG. 2 Is an electrical schematic of a motor vehicle cranking system containing starter motor assembly 20.

Referring now to FIG. 2, an electrical schematic of a system containing starter motor assembly 20 will be described. The system includes battery 30, the energy source for cranking the engine. The system further includes ignition switch 32. The operator of the vehicle closes ignition switch 32 when he/she desires to crank the engine in order to stag it.

Starter solenoid 22 includes a pull-in coil 34 and a hold-in coil 36. Pull-in coil 34 and hold-in coil 36 are magnetically coupled to a plunger 38. Plunger 38 is coupled to a movable electrical contact 40.

Three terminals of starter solenoid 22 are provided for connection external to starter solenoid 22. Battery terminal 42 (also commonly known as the "B+" terminal) is coupled to battery 30. Motor terminal 44 (also commonly known as the "M" terminal) is coupled to cranking motor 24. Also, motor terminal 44 is coupled to one end of pull-in coil 34. Start terminal 46 (also known as the "S" terminal) is coupled to the other end of pull-in coil 34 and to one end of hold-in coil 36. Further, start terminal 46 is coupled to ignition switch 32. The second end of hold-in coil 36 is coupled to ground through the metallic case of starter motor solenoid 22.

The system of FIG. 2 operates as follows (an operation which is known to those skilled in the art). When ignition switch 32 is closed, pull-in coil 34 and hold-in coil 36 magnetically draw movable contact 40 upward as viewed in FIG. 2, in order to connect battery terminal 42 and motor terminal 44. Cranking motor 24 is thus energized. (The movement of plunger 38 also engages pinion gear 26 (FIG. 1 ) to the ring gear of the engine.) The connection of battery terminal 42 and motor terminal 44 shorts out pull-in coil 34, leaving hold-in coil 36 to maintain the engagement of plunger 38. After the engine has staged and when ignition switch 32 is opened, movable contact 40 opens battery terminal 42 and motor terminal 44.

Figure 3:
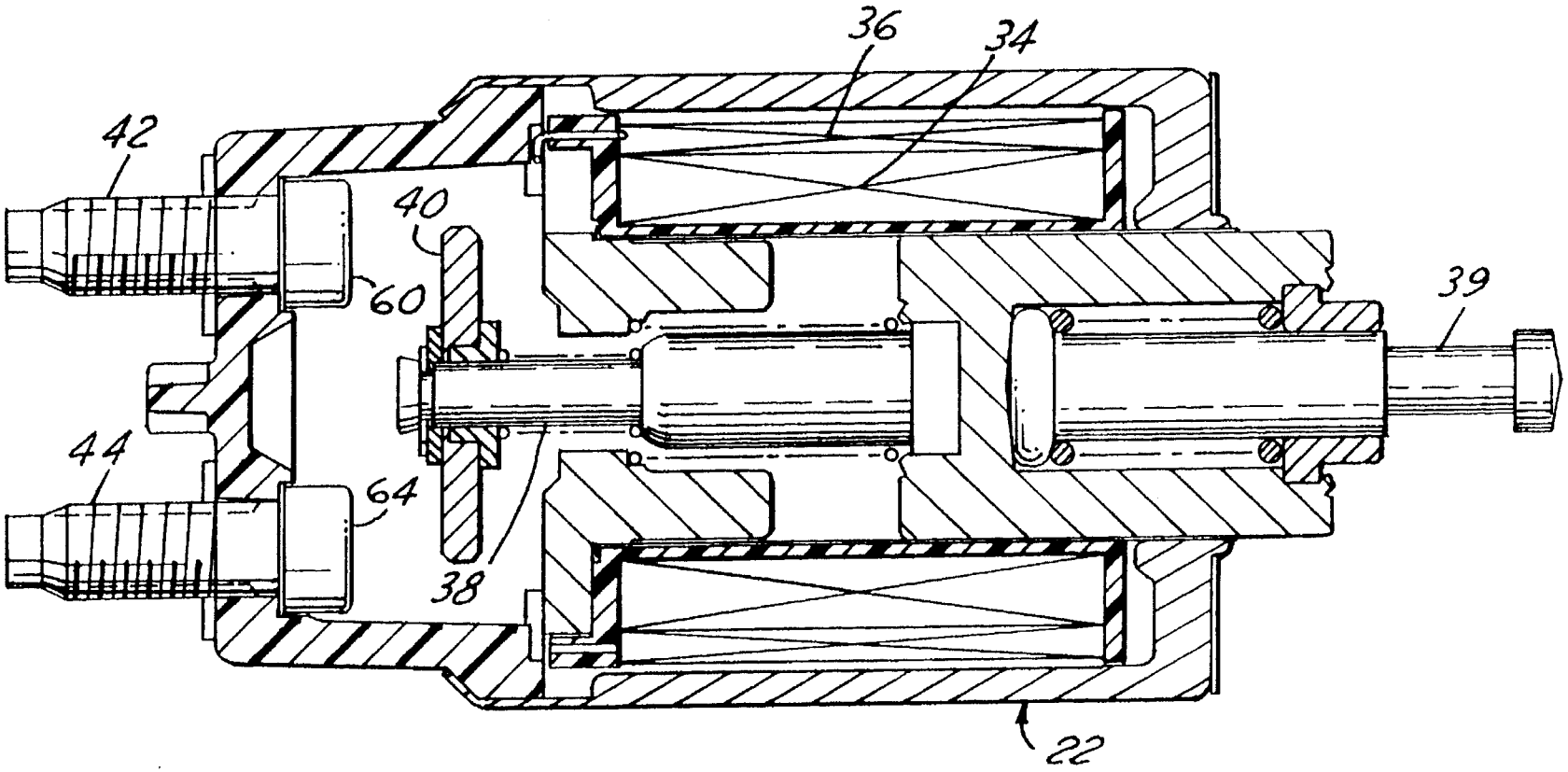
FIG. 3 cross-sectional side view of starter motor solenoid 22 of FIGS. 1 and 2.

Referring now additionally to FIG. 3, solenoid 22 is shown in cross-section.

In addition to those features described with reference to FIG. 2, solenoid 22 includes a first fixed contact 60. First fixed contact 60 is electrically coupled to battery terminal 42. Battery terminal 42 is externally threaded, such that an electrical cable can be attached to battery terminal 42 with a nut.

First fixed contact 60 is preferably made of copper. Also, first fixed contact 60 is preferably integrally formed with battery terminal 42, as opposed to being separately formed and subsequently attached to battery terminal 42. However, first fixed contact 60 can be separately formed and subsequently attached to battery terminal 42 by soldering, brazing, or other electrically-conductive attachment means. Further, battery terminal 42 can be tin-plated for corrosion resistance. Because first fixed contact 60 is coupled to battery terminal 42, tin-plating battery terminal 42 also generally implies that first fixed contact 60 is tin-plated as well.

Solenoid 22 also includes a second fixed contact 64. Second fixed contact 64 is electrically coupled to motor terminal 64. Motor terminal 64 is externally threaded.

Second fixed contact 64 is preferably made of steel. Second fixed contact 64 is preferably integrally formed with motor terminal 44. However, second fixed contact 64 can be separately formed and subsequently attached to motor terminal 44 by soldering, brazing or other electrically-conductive attachment means. Motor terminal 44 can be tin-plated for corrosion resistance. Because second fixed contact 64 is coupled to motor terminal 44, tin-plating motor terminal 44 also generally implies that second fixed contact 64 is tin-plated as well.

Movable contact 40 is preferably made of copper.

It is via movement of movable contact 40 into contact with fixed contacts 60 and 64 that solenoid 22 connects battery terminal 42 and motor terminal 44.

Starter solenoid 22 conducts very considerable current, in the hundreds of amperes, between battery terminal 42 and motor terminal 44. Particularly with such a large amount of current, one would not expect to use a fixed contact 64 made of steel. One would expect to select a material of higher electrical conductivity at the junction of movable contact 40 and fixed contact 64. One would also expect the selected material to be one which would be expected to maintain a high electrical conductivity at that junction over time and over many make/break cycles of starter solenoid 22. Copper is an example of a conventional material which might be selected for second fixed contact 64.

However, it has been demonstrated that after a relatively few make/break cycles of starter solenoid 22, a layer of copper is deposited from movable contact 40 to onto steel second fixed contact 64. This layer of copper has been demonstrated to maintain a reliable, high-conductivity electrical connection between movable contact 40 and second fixed contact 64 over the life of solenoid 22.

The use of steel in the integral construction of motor terminal 44 and second fixed contact 64 provides a very large cost advantage over the use of copper for the same purpose. Thus, because steel provides fully acceptable performance with a large reduction in cost, the use of steel provides a great advantage over alternative designs.

The use of steel in the construction of second fixed contact 64 also has been shown to have an unexpected benefit. The wear of movable contact 40 at the location where movable contact 40 contacts second fixed contact 64 has been shown to be decreased over a design in which both movable contact 40 and fixed contact 64 are made of copper. Thus, the durability of starter solenoid 22 is enhanced by the use of steel in the construction of second fixed contact 64.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A solenoid comprising:

first and second fixed contacts;

a movable contact adapted to switchably couple said first and second fixed contacts together;

wherein one of said fixed contacts is made of steel.

2. A solenoid as recited in claim 1, wherein said steel fixed contact is plated.

3. A solenoid as recited in claim 2, wherein said plating is tin plating.

4. A solenoid as recited in claim 1, wherein said movable contact is made of a material having higher electrical conductivity than steel.

5. A solenoid as recited in claim 1, wherein said movable contact is made of copper.

6. A solenoid as recited in claim 5, wherein the other said fixed contact is made of copper.

7. A solenoid as recited in claim 6, wherein said other fixed contact is plated.

8. A solenoid as recited in claim 7, wherein said other fixed contact is tin plated.

9. A solenoid comprising:

a first fixed contact;

a second fixed contact;

a movable contact adapted to switchably couple said first and second fixed contacts together;

wherein said movable contact and one of said fixed contacts are made of different base materials.

10. A solenoid as recited in claim 9, wherein said one of said fixed contacts is made of steel.

11. A solenoid as recited in claim 10, wherein said movable contact and the other said fixed contact are made of a common material.

12. A solenoid as recited in claim 10, wherein said one of said fixed contacts is plated.

13. A solenoid as recited in claim 9, wherein said movable contact and the other said fixed contact are made of a common material.

14. A cranking system for a motor vehicle, said system comprising:

an electrical power source;

a cranking motor;

a solenoid as recited in claim 1;

wherein the fixed contact made of steel is coupled to said cranking motor and the other fixed contact is coupled to said electrical power source.

15. A cranking system for a motor vehicle, said system comprising:

an electrical power source;

a cranking motor;

a solenoid as recited in claim 4;

wherein the fixed contact made of steel is coupled to said cranking motor and the other fixed contact is coupled to said electrical power source.

16. A cranking system for a motor vehicle, said system comprising:

an electrical power source;

a cranking motor;

a solenoid as recited in claim 6;

wherein the fixed contact made of steel is coupled to said cranking motor and the other fixed contact is coupled to said electrical power source.

17. A solenoid comprising:

a copper terminal stud having an integral first fixed contact;

a steel terminal stud having an integral second fixed contact; and a copper movable contact disposed in opposition to said first and second fixed contacts for switchably coupling said first and second fixed contacts.

18. An electrical system comprising:

a battery;

a cranking motor; and a solenoid as recited in claim 17;

wherein said steel terminal stud is electrically coupled to said cranking motor and said copper terminal stud is coupled to said battery.

19. A solenoid as recited in claim 17 wherein said terminal studs are tin plated.

20. An electrical system as recited in claim 18 wherein said terminal studs are tin plated.

* * * * *